US005810051A

United States Patent [19]

Campagna et al.

[11] Patent Number: 5,810,051

[45] Date of Patent: Sep. 22, 1998

[54] SUBSTANTIALLY BALANCED BIDIRECTIONALLY PIVOTED VALVE OPERATING APPARATUS

[75] Inventors: John A. Campagna; Jon Stevenson, both of Jefferson, Ohio

[73] Assignee: Rex International USA Inc., Ashtabula, Ohio

[21] Appl. No.: 743,236

[22] Filed: Nov. 5, 1996

[51] Int. Cl.[6] ..... A01G 25/09

[52] U.S. Cl. ..... 137/899; 251/59; 251/291

[58] Field of Search ..... 137/899; 251/59, 251/291; 60/470

[56] References Cited

U.S. PATENT DOCUMENTS 4,502,505 3/1985 Moller ..... 137/899
4,687,719 8/1987 Smith ..... 251/59
5,101,862 4/1992 Leete ..... 251/59
5,257,771 11/1993 Portis et al. ..... 251/59
5,340,078 8/1994 Dean ..... 251/59
5,381,996 1/1995 Arnemann et al. ..... 251/59

*Primary Examiner*—Denise L. Ferensic
*Assistant Examiner*—John Ball
*Attorney, Agent, or Firm*—Woodling, Krost and Rust

[57] ABSTRACT

The valve operating apparatus cycles valves between open and closed positions. The valve operating apparatus includes a trailer for use in towing behind other vehicles, for instance, behind a pickup truck. The trailer includes an engine, pump, battery, reservoir and a bidirectionally oriented motor which is suspended from a telescoping extension bar. The operation of the valve operating apparatus is substantially balanced and requires very little effort by the operator to operate. Specifically, the operator does not have to push down or lift the apparatus as it is substantially balanced.

7 Claims, 12 Drawing Sheets

SUBSTANTIALLY BALANCED BIDIRECTIONALLY PIVOTED VALVE OPERATING APPARATUS

BACKGROUND OF THE INVENTION

1. Field of the Invention

The invention is in the field of valve operating devices. Municipal water lines employ numerous valves below ground which must be periodically cycled/tested to ensure operability. Municipal valves are frequently located in difficult to reach places such as tree lawns and on private property. Therefore, there is a need to gain access to these valves and to operate them. Additionally, the terrain in which these valves are located is not always flat thus necessitating a means to accommodate the terrain.

2. Related Art

Several valve operators exist. Some valve operators are trailer mounted but are not balanced. Instead they are adapted to be placed substantially over the valve and valve well. Some valve operators telescope for towing, moving and operating but are not substantially balanced in operation. COMPAC Equipment Mfg. Inc. of Woodville, Ontario advertises its PHD (Post Hole Digger) as having an engine base that swivels to keep the engine level and balance operation. Further, COMPAC advertises swivel and rotation joints to permit work on slopes at any angle. However, COMPAC's literature does not show or disclose balanced, bidirectionally pivoted operation of a valve operating apparatus as disclosed and claimed herein. COMPAC's motor must remain level so as to keep the engine adequately lubricated. COMPAC's statement about "balancing" in its literature is directed toward engine balancing in operation and does not refer to balancing of the apparatus.

SUMMARY OF THE INVENTION

The present invention is directed to a substantially balanced valve operating apparatus. The valve apparatus is trailer mounted and includes a valve motor extendable to different lengths from the approximate center of the trailer. The valve motor is bidirectionally pivoted about two axes. Substantial balancing of the apparatus enables operation of valves without much application of force on the handle. The weight of the valve motor, controls, and extendable channels substantially counterbalances the weight of the pump, engine, gas tank, and frame. The valve motor and controls are adjustably extendable meaning that the operator can customize the operation of the apparatus to fit his or her needs or preferences. Some operators prefer a slight bias in the downward direction as it has been found that this maintains the female valve key on the male valve stud during operation of the valve.

The valve motor and controls are extendable with respect to the trailer by means of: a first, outer, channel which is mounted to a skid atop the reservoir; a second, inner, channel residing partially inside and movable with respect to the first, outer channel; and a distal, outer channel which supports the valve motor and controls. The distal, outer channel is affixed to the second, inner, channel and moves therewith and is adjustable with respect to the first, outer channel. By distal it is meant further away from the approximate center of the trailer. The approximate center of the trailer is in the vicinity of the reservoir.

A first shroud is pivotally mounted to the distal, outer channel enabling limited rotation with respect to the outer channel. A second shroud is pivotally mounted to the first shroud enabling limited rotation with respect to the first shroud. The valve motor is affixed to the second shroud. Thus, the valve motor can be aligned with the valve to be operated. Occasionally, the valve motor cannot be located directly above the valve and in alignment therewith due to the topography or due to the installation of the valve.

It is an object of the present invention to provide a valve operating apparatus which is adjustably extendable to a position whereby the valve operating apparatus is substantially balanced. This enables operation without the application of substantial force on the handle of the valve operating apparatus in either the upward or downward direction. Further, it is an object of the present invention to provide a valve operating apparatus which is adjustably extendable to a position whereby the operator is required to provide a substantial force in either the upward or downward direction as desired by the operator. In this way the operator can select the extension of the distal, outer channel such that he or she will have to apply substantial force so as to maneuver the valve motor, controls and valve key. This accommodates the need to bias the valve motor and valve key so that the valve key and/or valve key extension will better remain on the nut of the valve being operated.

Further it is an object of the present invention to provide bidirectional adjustment of the valve motor with respect to the valve to be cycled/tested. In this way the valve motor does not have to be oriented directly above the valve to be cycled/tested.

Further, it is an object of the present invention to provide a valve operating apparatus which includes a trailer, frame, wheels and an adjustable distal outer channel which absorbs the torque of the valve motor.

Further objects and a better understanding of the invention may be had by referring to the drawings which are briefly described below.

BRIEF DESCRIPTION OF THE DRAWINGS

FIG. 6 illustrates the second shroud being pivotal with respect to the first shroud and the first shroud being pivotal with respect to the support mounts affixed to the distal outer channel.

FIG. 7 illustrates the bidirectionally pivoting capability of the second shroud with respect to the first shroud and the first shroud with respect to the support mounts affixed to the distal outer channel.

FIG. 10 illustrates the extension bar oriented off center.

FIG. 11 also illustrates the manifold.

A better understanding of the invention may be had be referring to the Detailed Description of the Invention and the Claims which follow.

DETAILED DESCRIPTION OF THE INVENTION

Figure 1:
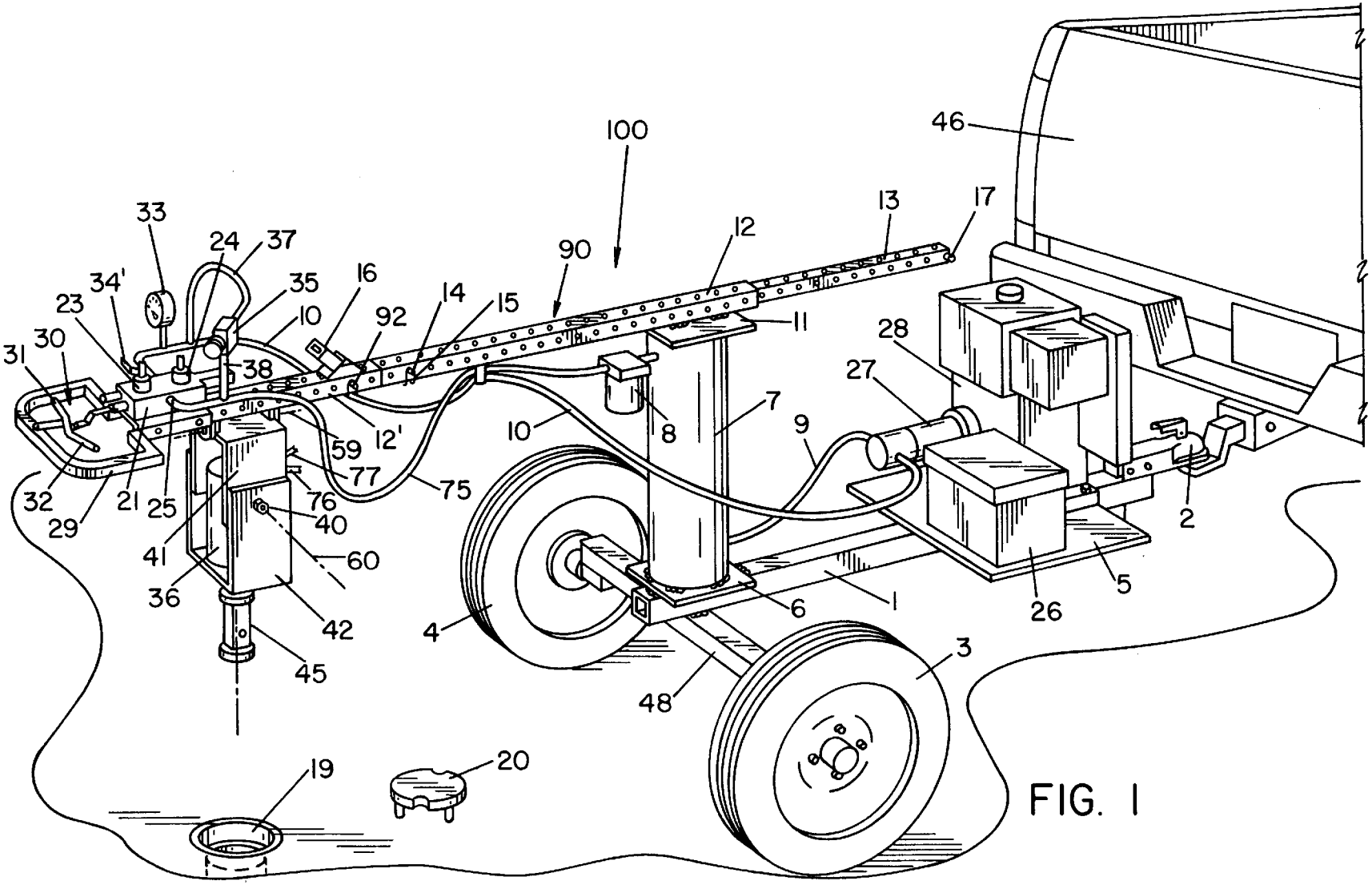
FIG. 1 is a perspective view of a first embodiment of the valve operating apparatus illustrating the trailer, pump, reservoir, telescoping extension bar, first and second shrouds, and valve motor.

Referring to FIG. 1, the trailer 100 is illustrated in perspective. In FIG. 1 the trailer 100 is illustrated in engagement with a truck 46 for towing therewith. Trailer 100 comprises: a skid for mounting the engine and gas tank 28, battery 26, pump 27, trailer frame 1, an axle 48 affixed to the frame 1, left wheel/tire 4, right wheel/tire 3, reservoir 7, a first outer channel affixed 12 to skid 11 mounted to reservoir 7, an inner channel 13 movable within the first outer channel 12 and affixed to the distal outer channel 12' from which first shroud 41 is pivotally mounted, a second shroud 42 upon which valve motor 36 is mounted, and, the second shroud 42 being pivotally mounted to first shroud 41. FIG. 1 illustrates the distal outer channel 12' secured by pin 14 and safety clip 15. A cotter pin could be alternatively be used instead of a safety clip 15.

Figure 3:
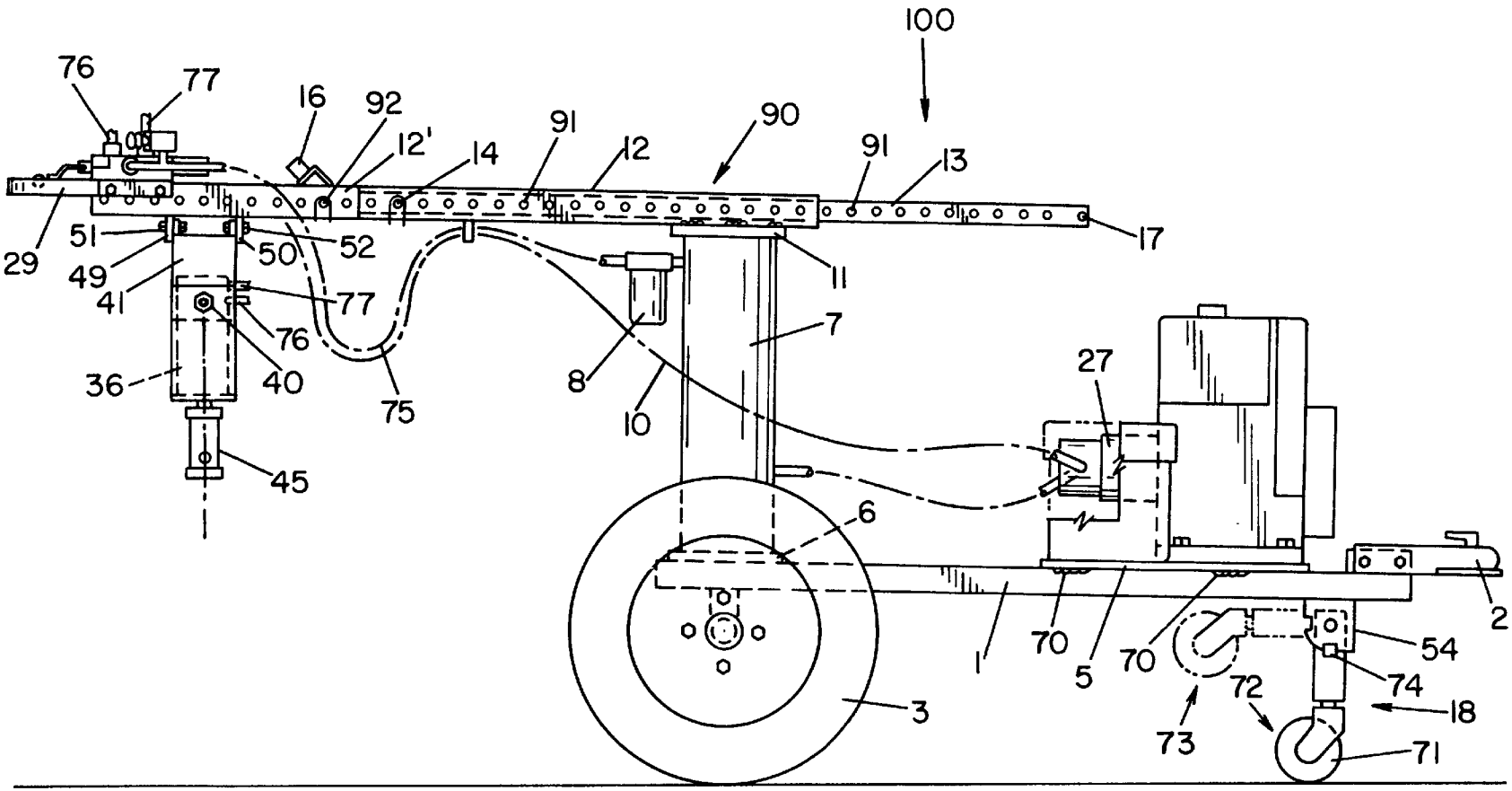
FIG. 3 is a side view of a first embodiment of the valve operating apparatus illustrating the trailer wheel engaged with the ground and the telescoping extension bar and valve motor prior to the bar's extension.

Trailer hitch 2 secures the trailer 100 to truck 46. FIG. 3 illustrates trailer 100 with the retractable trailer supporting assembly 18 in its downward position. Wheel 71 supports the trailer as shown in FIG. 3. Latch 74 secures wheel 71 in place so as to support the trailer. Reference numeral 73 is used to indicate the upward, retracted position of wheel 71. Reference numeral 72 is used to indicate the downward position for support wheel 71.

FIG. 3 illustrates the extension bar 90 in its retracted position as evidenced by the rightward extension of the second, inner channel 13. Second pin 17 limits the second, inner channel 13 from being extended too far with respect to the first, outer channel 12. Put another way, second pin 17 prohibits the extraction of the second inner channel 13 leftwardly during extension of the extension bar 90.

Channels 12, 12' and 13 are generally rectangularly shaped. Matching apertures 91 in the channels permit adjustment of the channels relative to each other. First, outer channel 12 is mounted to skid 11 which is mounted on top of the oil reservoir 7. Second, inner channel 13 is movable within and relative to first, outer channel 12. Distal outer channel 12' moves with inner channel 13 as it is fixed thereto by third pin 92. Pin 92 further permits limited adjustment of the distal outer channel 12' with respect to inner channel 13 if so desired. Third pin 92 permits the removal of distal outer channel 12' from the inner channel 13 to facilitate maintenance.

Rightward movement of the second, inner channel 13 and the distal outer channel 12' is limited by the abutment of distal outer channel 12' against first outer channel 12. It will be further understood that the pins 14, 17 and 92 may be oriented vertically instead of horizontally in the apertures 91.

Figure 4:
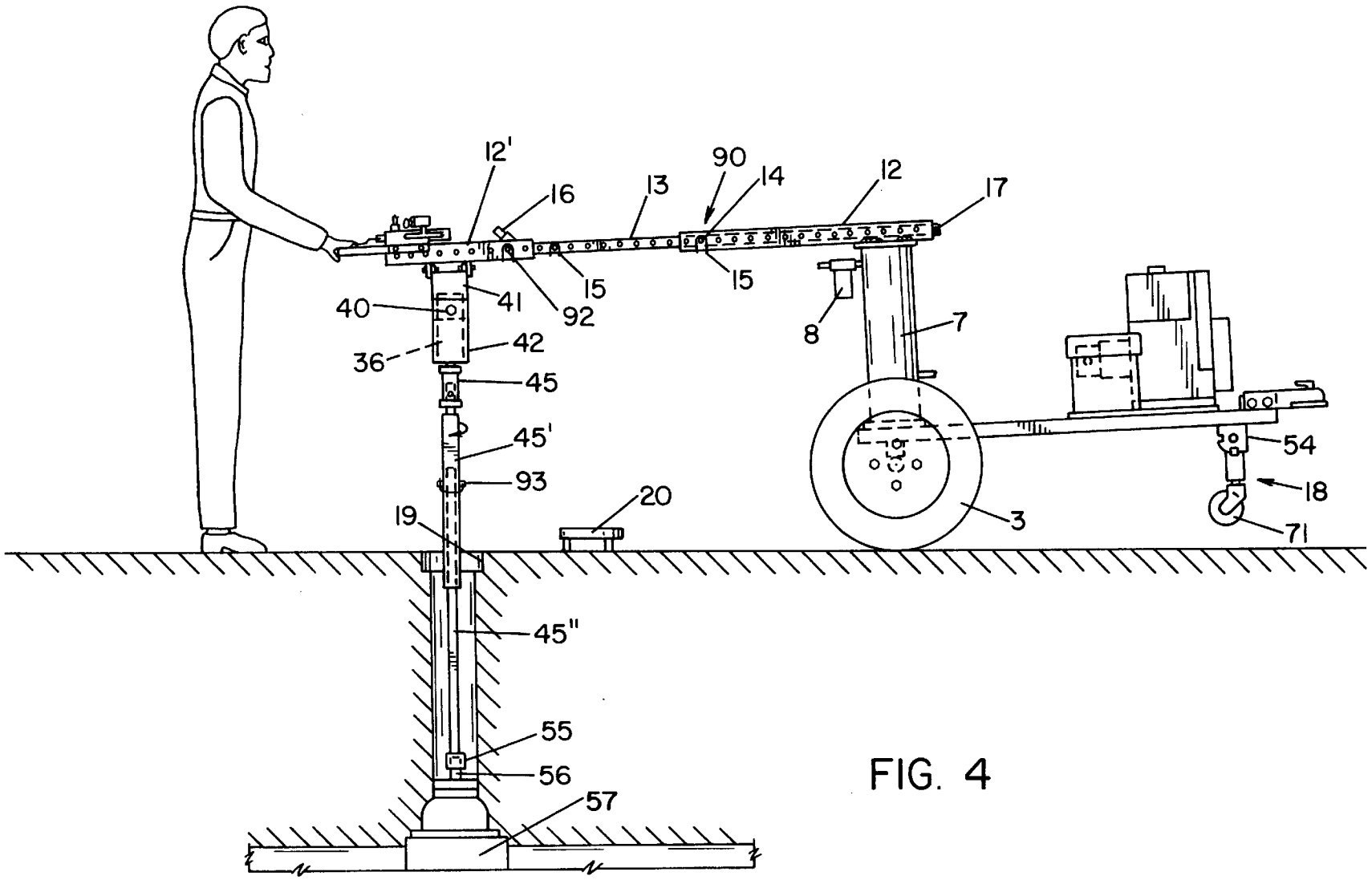
FIG. 4 is a side view of a first embodiment of the valve operating apparatus illustrating the operation of a valve below grade.

FIGS. 1 and 4 illustrate valve casing 19 and valve casing cover 20. FIG. 4 illustrates valve key 45, a first valve key extension 45' and a second adjustable valve key extension 45" employed to operate valve 57. First valve key extension 45' and second valve key extension 45" are channels affixed together by fourth pin 93. Fourth pin 93 is adjustable within apertures located in the extension 45', 45" allowing for adjustment to enable operation of valves at different depths below grade. Municipal valves typically have a male stud 56 which mates with a female opening 55 on the adjustable extension 45".

Figure 2:
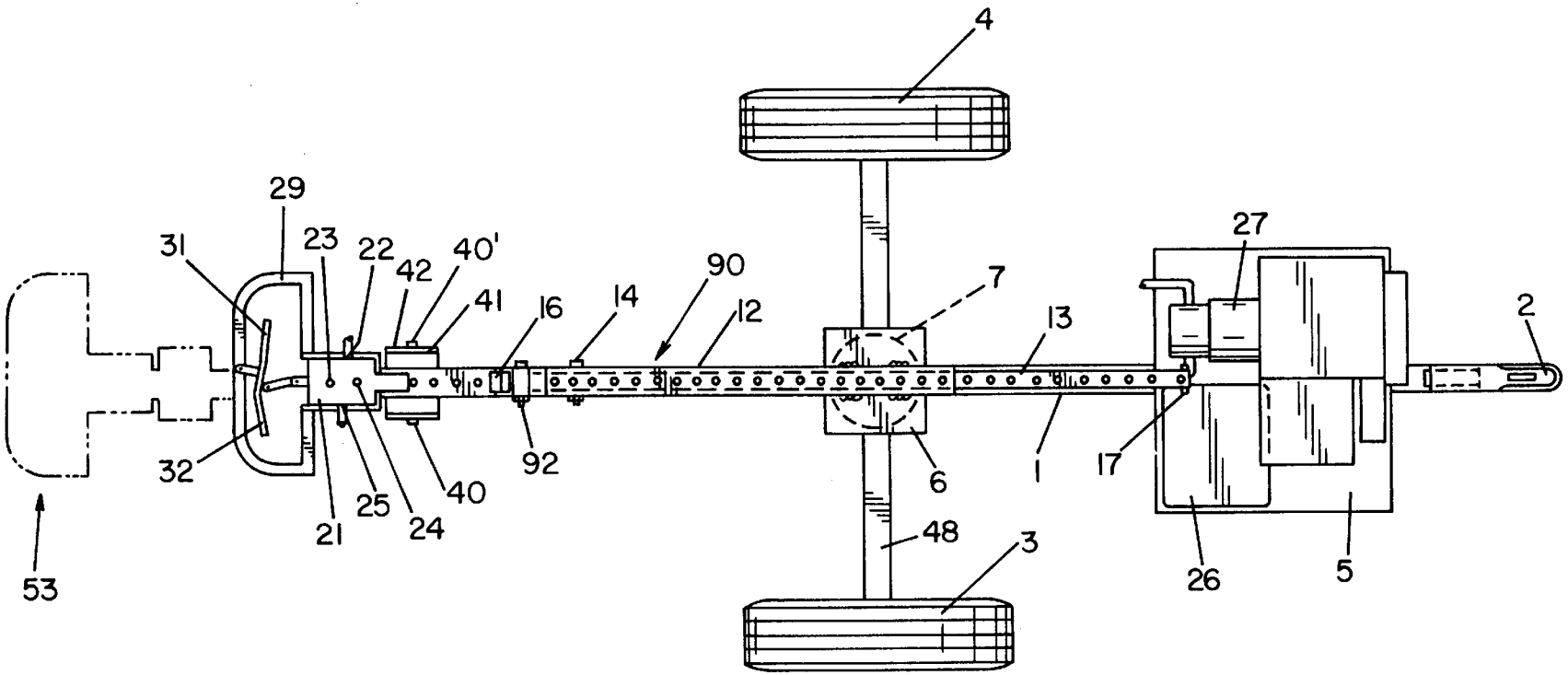
FIG. 2 is a top view of a first embodiment of the valve operating apparatus illustrating the trailered position of the extension bar and an extended position of the extension bar and valve motor.
Figure 9:
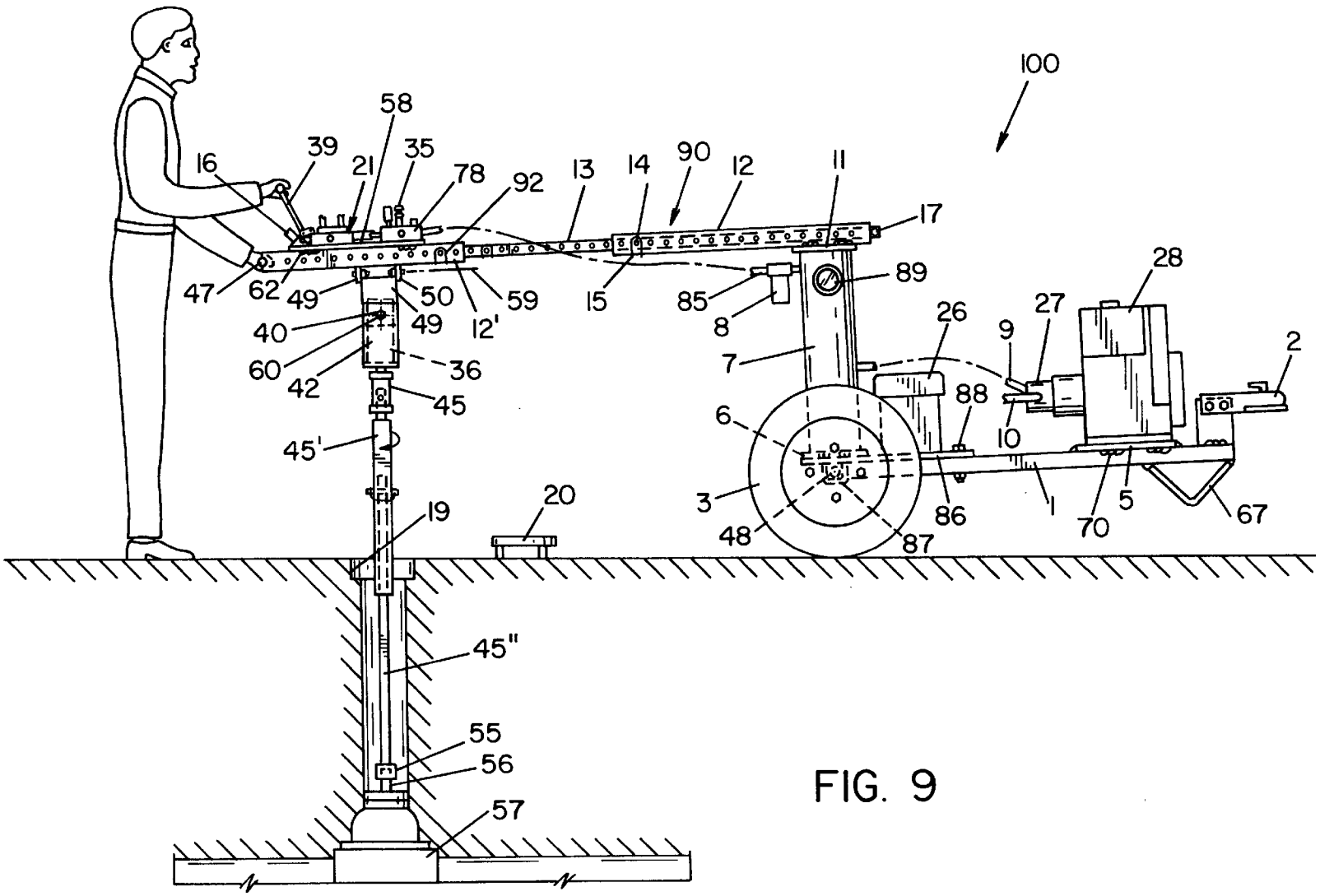
FIG. 9 is a side view of a second embodiment of the invention illustrating the operation of a valve below grade.
Figure 10:
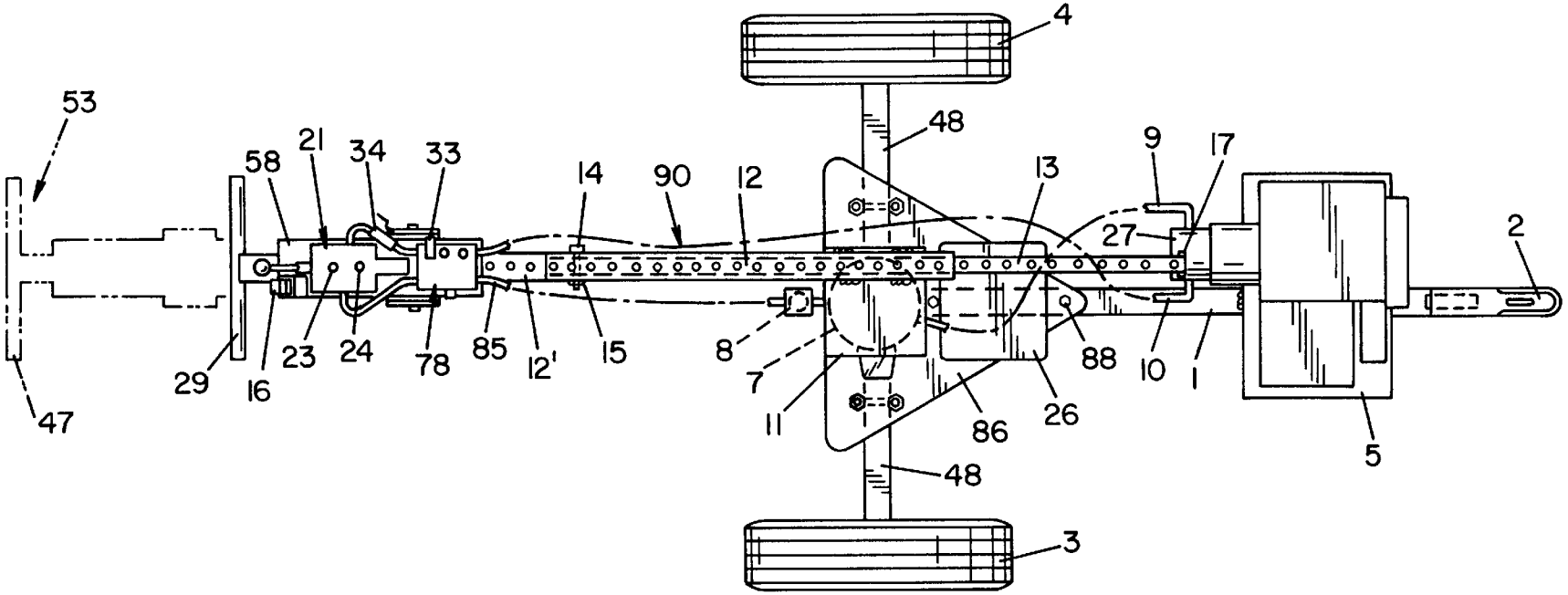
FIG. 10 is a top view of a second embodiment of the invention illustrating a triangular base plate supporting the reservoir and the battery.

FIGS. 1, 2, 3 and 10 illustrate rightward extension of the second inner channel 13 with respect to the first outer channel 12. This is known as the trailered position. FIGS. 4 and 9 illustrate maximum leftward extension of the inner channel 13 and distal outer channel 12'. FIGS. 2 and 10 additionally show the leftward extension of the inner channel 13 and outer channel 12' in phantom.

FIG. 1 illustrates a skid 6 for mounting reservoir 7. Frame 1 is similarly mounted to axle 48. Skid 5, which in the embodiment illustrated in FIG. 1 is secured to the frame 1 by welds 70, supports the battery 26, engine and gas tank 28, and pump 27. Hydraulic line 9 connects the reservoir to the pump for communicating fluid therebetween. The pump discharges pressurized fluid through conduit 10. Conduit 10 is connected to the four way, three position valve 21. Pressure gauge 33 indicates the pressure supplied to the four way, three position valve. Pressure relief valve 35 is located intermediate the pressure supply line 10 and the pressure return line 75. Pressure return line 75 extends from the four way, three position valve 21 to oil filter 8 which resides in the flow path back to reservoir 7. Hydraulic line 37 interconnects the pressure supply line 10 and the pressure relief valve 35. Hydraulic line 38 interconnects the pressure relief valve 35 and the return line 75. Shut off valve 34 resides in the hydraulic supply line 10 and is positioned just before the entrance to the four way, three position valve 21. Shut off valve 34 has handle 34' for operation thereof Four way, three position valve 21 is mounted on support plate 58. Support plate is welded to distal outer channel 12' by means of weld 62. Handle 29 and support plate 58 are affixed to to the distal outer channel 12'. See, FIG. 7. Control bar 30 includes includes a forward control bar 31 and a reverse control bar 32. The control bar is best viewed in FIG. 5. When the control bar 30 is not manipulated by pulling either forward control bar 31 or reverse control bar 32 toward the handle 29, the four way, three position valve 21 assumes a neutral position whereby fluid does not flow therethrough. See, FIG. 8.

Figure 5:
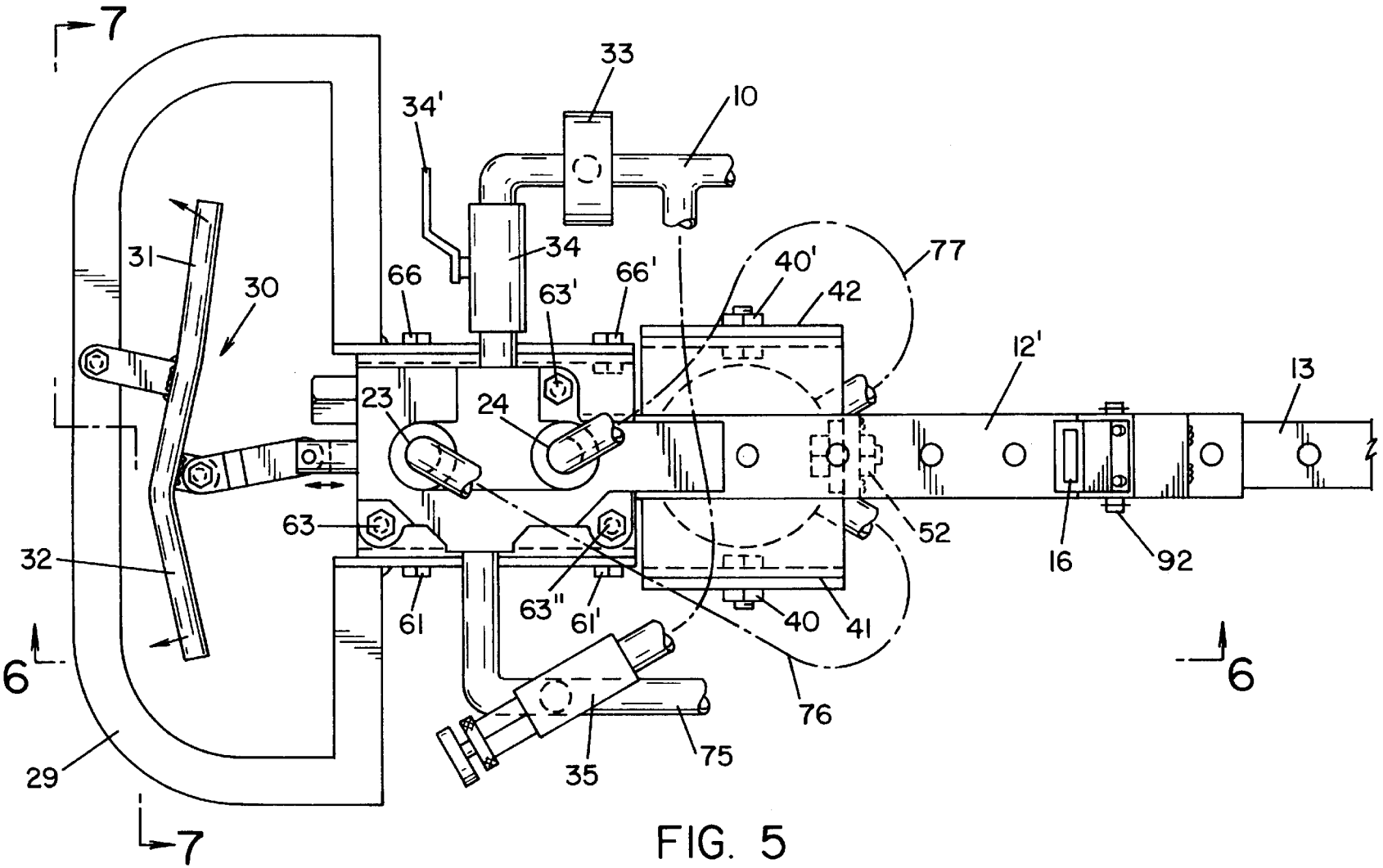
FIG. 5 is a top view of a first embodiment of the control means and the valve motor illustrating the interconnection of various hydraulic lines and the forward and reverse control bar.
Figure 8:
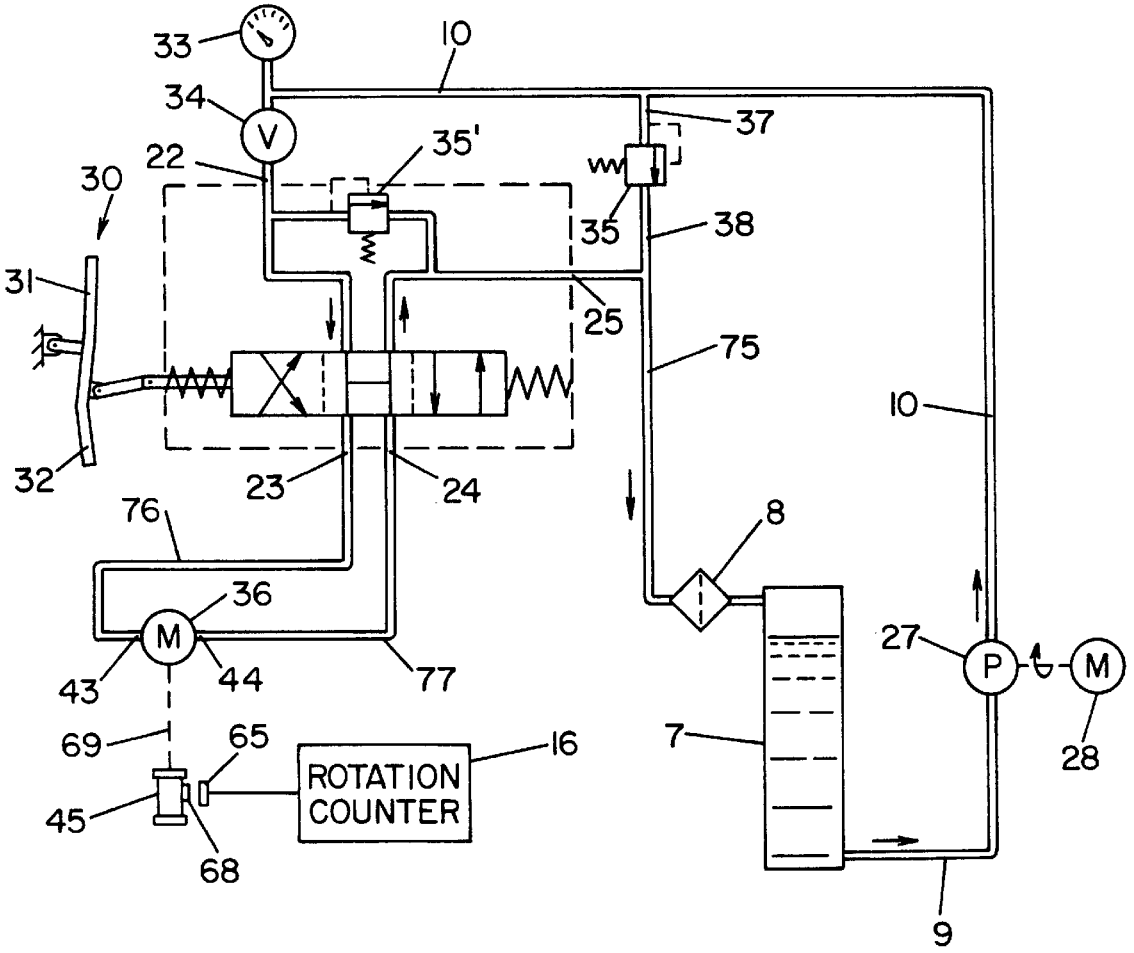
FIG. 8 is a schematic of the first embodiment of the invention.

Referring to FIGS. 5 and 8, four way, three position control valve 21 includes a first supply port 22, second port 23, third port 24, and fourth return port 25. Additionally, valve 21 includes an internal relief valve 35' which interconnects the supply port 22 and the return port 25 in over pressure situations. This relief valve 35' is set such that it functions as a backup to primary relief valve 35. It will not operate unless relief valve 35 fails to operate in over pressure situations. A rotation counter 16 counts rotations of key 45. Magnetic pickup 65 in conjunction with magnet 68 are electrically connected to rotation counter 16.

FIG. 3 illustrates a first support 49 for pivotally mounting upper shroud 41 to distal outer channel 12' and a second support 50 for pivotally mounting the upper shroud 41 to distal outer channel 12'. Bolts 51 and 52 pivotally mount the upper shroud 41 to the first and second supports 49 and 50. Reference numerals 40 and 40' indicate bolts for pivotally mounting the lower shroud 42 to the upper shroud 41. Valve motor 36 which is a hydraulic motor is bolted to the lower shroud 42. See FIG. 7.

Figure 7:
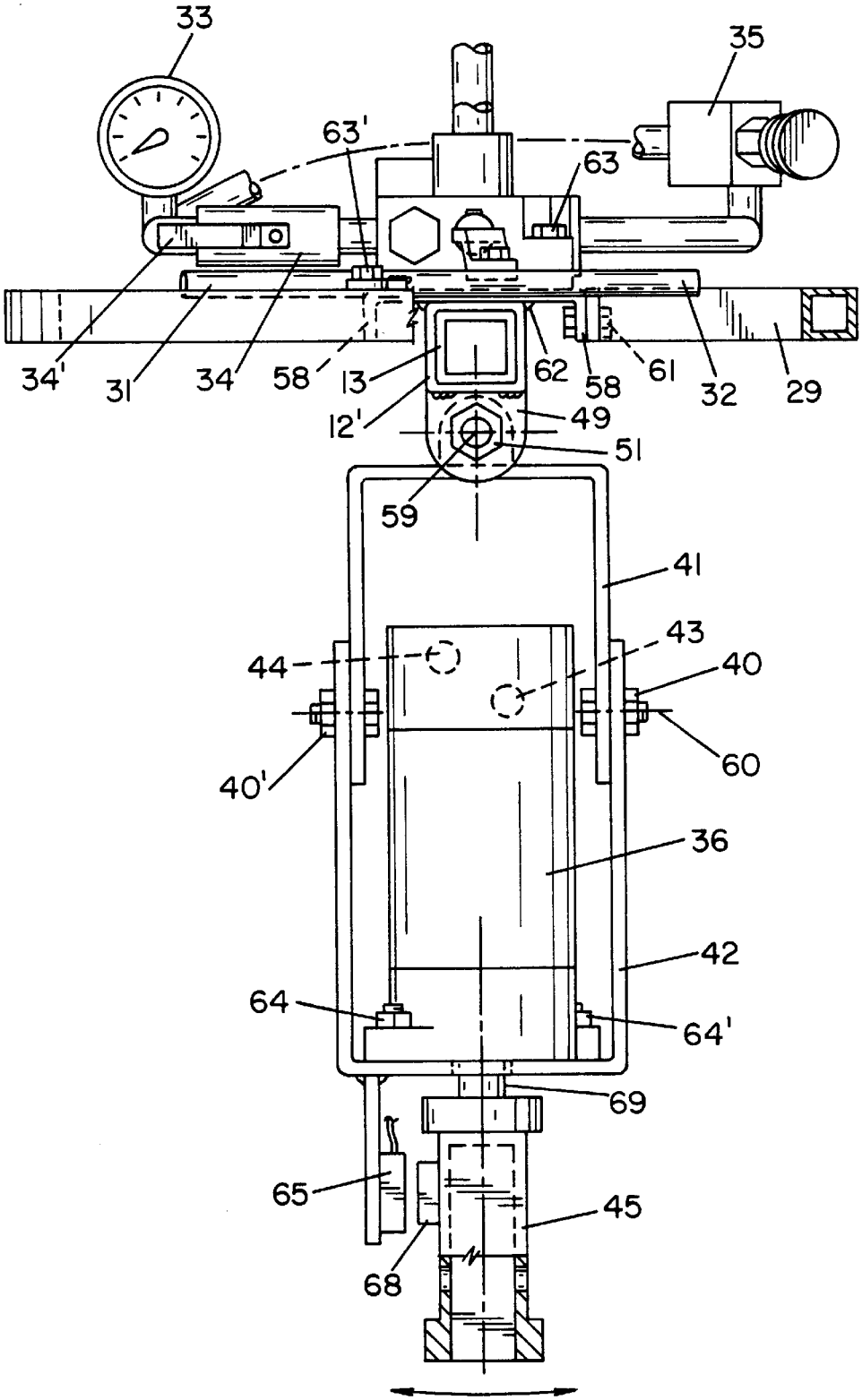
FIG. 7 is a frontal view of a first embodiment of the invention illustrating the control means and valve motor.

FIG. 7 illustrates bolts 64 and 64' which secure the hydraulic motor 36 to the lower shroud 42. Valve motor 36 includes power/return ports 43, 44 for connection with the four way, three position valve 21. Valve motor 36 can be operated in either a forward or reverse direction depending upon the actuation of the forward control bar 31 and the reverse control bar 32. When the control bar 30 is not actuated, the four-way, three position valve is in the neutral position as shown in FIG. 8. When forward control bar 31 is grasped by the operator and pulled toward handle 29, ports 22 and 24 are in communication and ports 23 and 25 are in communication. In this way, valve motor 36 operates in a first, forward rotational direction. Similarly, when reverse control bar 32 is grasped and pulled toward handle 29, ports 22 and 23 of valve 21 are in communication and ports 25 and 24 of valve 21 are in communication. In this way valve motor 36 operates in a second, reverse rotational direction. See FIG. 5.

FIG. 7 also illustrates the shaft 69 interconnecting with key 45. Magnet 68 is shown in proximity with magnetic pickup 65. Reference numeral 59 illustrates the axis about which upper shroud 41 rotates. Similarly, reference numeral 60 indicates the axis about which lower shroud 42 can pivot with respect to upper shroud 41. The axes 59, 60 are at right angles with respect to each other. Distal outer channel 12' is welded to support plate 58. Handle 29 is bolted to support plate 58 by means of bolts 61, 61', 66 and 66'. See FIGS. 5 and 7. Four way, three position valve 21 is secured to support plate 58 by means of bolts 63, 63' and 63". See FIG. 7.

Figure 6:
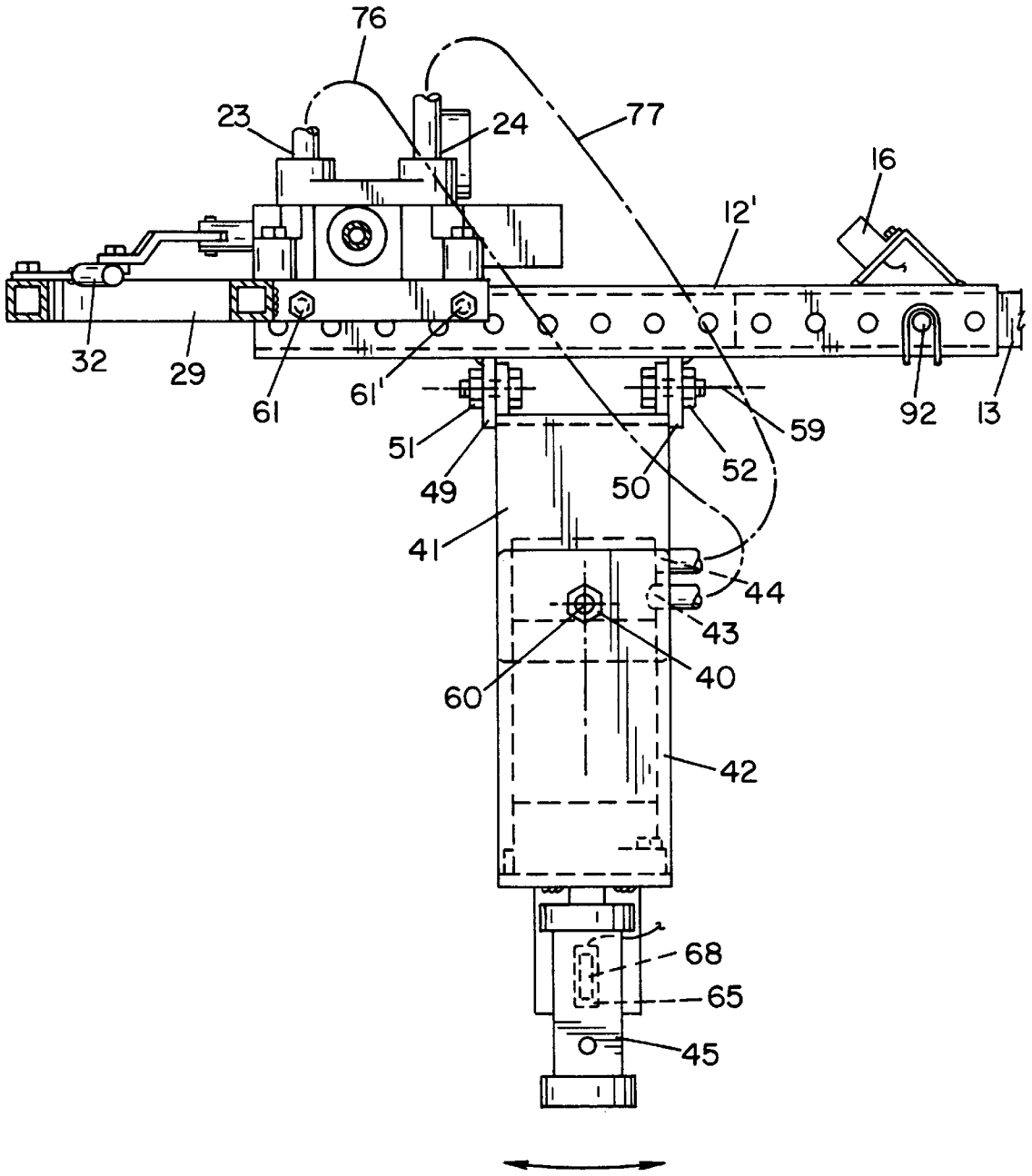
FIG. 6 is a front view of a first embodiment of the invention illustrating a portion of the telescoping extension bar, control means and valve motor.

Referring to FIG. 6, conduit 76 interconnects port 43 of the valve motor with port 23 on the valve 21. Similarly, conduit 77 interconnects port 44 on the valve motor with port 24 of the valve 21.

FIG. 9 illustrates a side view of a second embodiment of the invention. FIG. 9 illustrates manifold 78. Valve 21 is operable with a single push pull handle 39. Push-pull handle 39 operates valve 21 in the same way as the control bar 30. FIG. 9 also illustrates a triangular plate 86 for supporting the reservoir 7 and the battery 7. U-bolts 87 affix the axle 48 to the plate 86. It will be understood that axle 48 is a non-rotating axle. Bolts 88 affix the plate 86 to the trailer frame 1. Warning light 89 serves to identify others of work in progress and can be used during towing of the apparatus.

FIG. 9 employs a single handle 47 having a T shape. FIG. 9 includes skid 67 for supporting trailer frame 1 and support plates 5, 86. It will be noted that support plate 5 is welded to trailer frame 1 by means of welds 70. Skid 67 is somewhat preferable to use where the terrain is rough. The wheel arrangement depicted in FIG. 3 may become dislodged with respect to bracket 54 which affixes the wheel assembly shown in FIG. 3 to the trailer frame 1 in rough terrain.

Referring to FIGS. 3 and 9, skid 67 and/or the wheel arrangement 18 keep the pump and the motor which powers the pump, substantially level at all times. This is necessary to lubricate the motor. When the valve operating apparatus is being towed the wheel assembly 18 shown in FIG. 3 is retracted and is sufficiently high enough to clear the ground/road. Skid 67 shown in FIG. 9 is sufficiently high enough to clear the ground/road during towing.

FIGS. 4 and 9 illustrate the distal outer channel 12' being fully extended in a leftward direction. Pin 17 prohibits the over extension of inner channel 13 and distal outer channel 12' which moves with inner channel 13. It will be readily understood by those skilled in the art that the positions of the distal outer channel illustrated in FIGS. 4 and 9 are just one of a plurality of positions which can be assumed by the distal outer channel 12'. For instance the distal outer channel 12' need not be extended as far as it is shown in FIGS. 4 and 9. FIGS. 4 and 9 represent the condition where the valve operating apparatus is substantially balanced. In other words, the weight of the valve motor 36, the shrouds 41, 42, the valve controls, and the extension bar 90 substantially counterbalances the weight of the engine 28, pump 27, battery 26, and the trailer frame 1 and support plates. If the operator desires another configuration where the valve operating apparatus is not substantially balanced, he may position the distal outer channel 12' in a somewhat more rightward direction. In other words, he may position the distal outer channel 12' somewhere between the extremes shown in FIGS. 1 and 4. Similarly in referring to FIG. 10 the operator may position the distal outer channel 12' somewhere between the position shown in heavy lines as compared to the position shown in phantom 53.

Referring again to FIGS. 4 and 7, misalignment between the valve 57 and the valve motor 36 can be compensated for through the rotational adjustment of the shrouds about axes 60 and 59. Axis 59 provides for rotation of the first shroud 41 with respect to the distal outer channel 12' and axis 60 provides for rotation of the second shroud 42 with respect to the first shroud 41. Rotation about two axes is sometimes referred to herein as bidirectional rotation. Bidirectional rotation could also be described as biaxial rotation or rotation about two axes. The rotation of the second shroud 42 with respect to the first shroud 41 is about the axis 60. The rotation of the upper shroud 41 with respect to the distal outer channel 12' is about the axes 59.

FIG. 10 is a top view of a second embodiment and illustrates in phantom the extended position 53 of the extension bar and controls. It will be noticed from reviewing FIG. 10 that the extension bar comprising the first outer channel 12, the inner channel 13 and the distal outer channel 12' have been offset such that they reside more toward tire 4. In other words, the extension bar is not aligned with the trailer frame 1 but is offset parallel to it.

Figure 11:
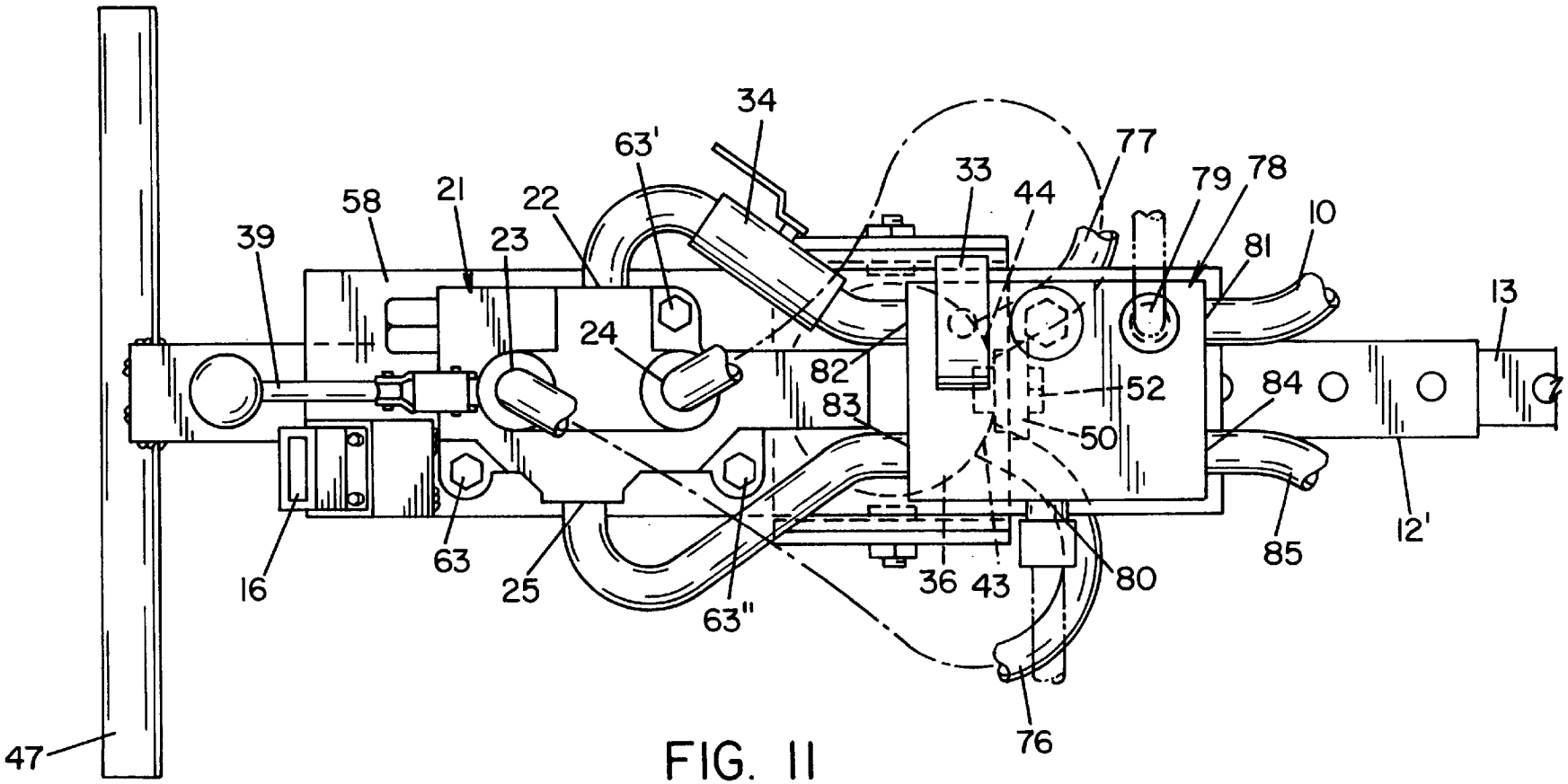
FIG. 11 is a top view of a second embodiment of the four-way three position control valve operable by pushing and pulling a single handle.
Figure 12:
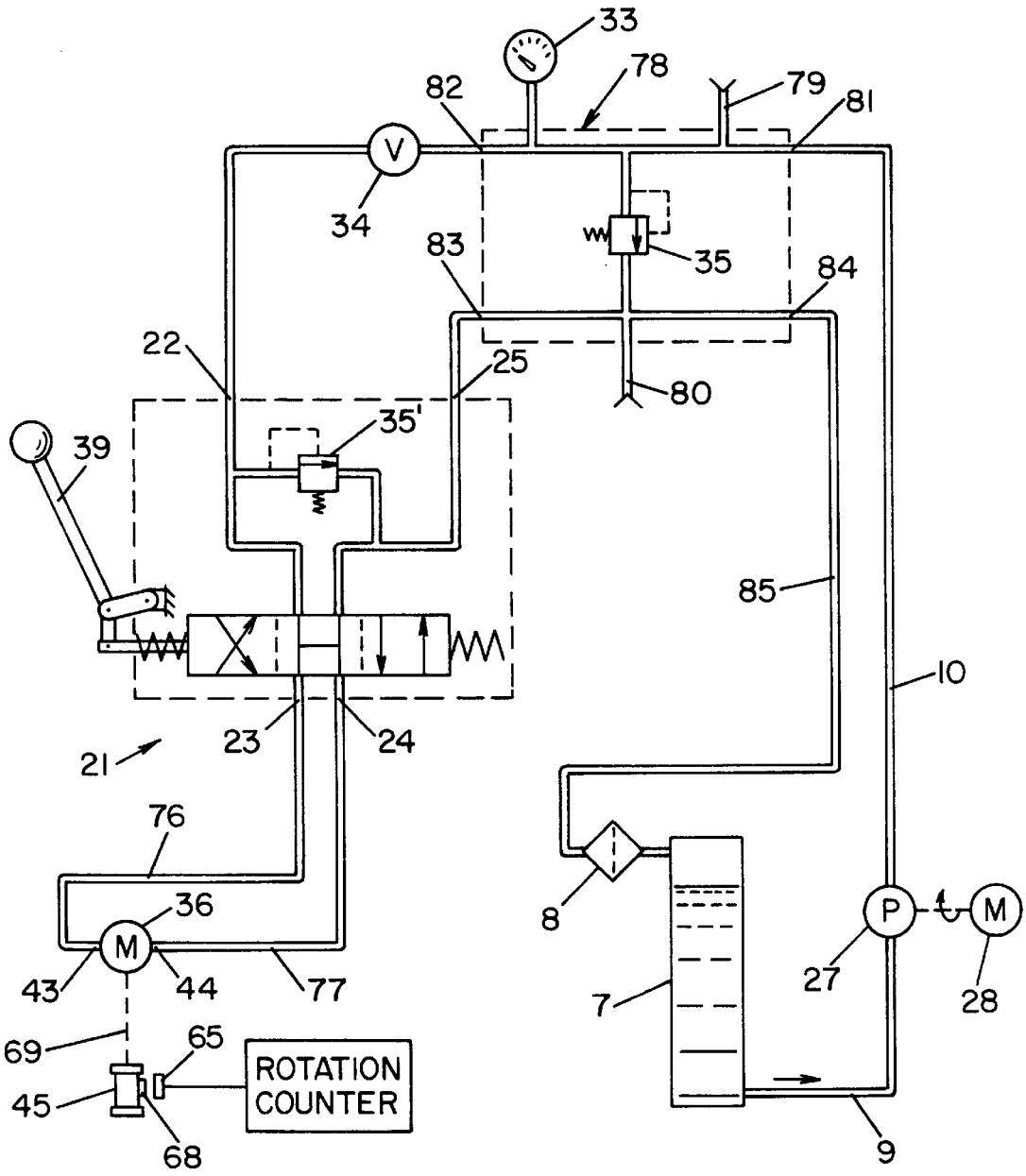
FIG. 12 is a schematic of a second embodiment of the invention illustrating, among other things, the manifold.

FIG. 11 illustrates in an enlarged fashion the manifold 78 having auxiliary power port/line 79 and an auxiliary return port/line 80. Manifold 78 further includes a first power supply port 81, a second power output port 82, a third return port 83 and a fourth return port 84 for connection with the reservoir. Return line 85 interconnects manifold 78 with oil filter 8. Manifold 78 has the advantages of simplifying the number of fluid interconnections necessary in the invention. FIG. 12 is a schematic representation of the second embodiment shown in FIGS. 9–11. It is substantially similarly to the first embodiment schematically shown in FIG. 8 with the exception of the manifold 78 and the single push pull control lever 39.

Wheels/tires 3 and 4 absorb the torque generated by valve motor 36 during operation of a valve. Specifically, the torque of the valve motor 36 is transmitted through the shrouds 41, 42, the distal outer channel 12', the inner channel 13, the reservoir 7 and skids associated therewith, the frame 1 and the axle 48 to the wheels/tires 3 and 4. By absorb it is meant that the valve operating apparatus does not move or slide with respect to the earth.

It will be understood by those skilled in the art that the embodiments shown herein are merely exemplary in nature and are not intended to limit the scope and the spirit of the claimed invention.

What is claimed is:

1. A valve operating apparatus for rotating a valve comprising a trailer, a reservoir affixed to said trailer, a telescoping extension bar affixed to said reservoir, a pump mounted on said trailer, a valve motor powered by said pump, a first shroud pivotally mounted to said telescoping extension bar, a second shroud pivotally mounted to said first shroud, said valve motor affixed to said second shroud, a valve key affixed to said valve motor for rotatably operating a valve, said telescoping extension bar extendable to one of a plurality of positions, said valve operating apparatus being substantially balanced when said telescoping extension bar is extended to one of said plurality of positions enabling operation of said valve operating apparatus without substantial application of force to said telescoping extension bar.

2. A valve operating apparatus for rotating a valve as claimed in claim 1 further comprising control means for operating said valve motor in a forward direction and a reverse direction.

3. A valve operating apparatus for rotating a valve as claimed in claim 2 wherein said trailer further includes an axle and first and second wheels.

4. A valve operating apparatus for rotating a valve as claimed in claim 3 wherein said control means includes a four-way, three-position control valve.

5. A valve operating apparatus for rotating a valve comprising a trailer, said trailer includes a frame, first and second wheels affixed to said frame, a reservoir affixed to said frame of said trailer, a telescoping extension bar affixed to said reservoir, a pump mounted on said trailer, a first shroud pivotally mounted on and rotatable relative to said telescoping extension bar enabling rotation of said first shroud in a first direction, a second shroud pivotally mounted on and rotatable relative to said first shroud enabling rotation of said second shroud in a second direction, a valve motor affixed to said second shroud, said valve motor being powered by said pump and generating torque when operating, a valve key affixed to said valve motor for rotatably operating a valve, said telescoping extension bar extendable to one of a plurality of positions, said valve operating apparatus being substantially balanced when said telescoping extension bar is extended to one of said plurality of positions enabling operation of said valve operating apparatus without substantial application of force to said telescoping extension bar, said first and second rotatable shrouds permitting alignment of said valve key with said valve for rotating said valve, and, said first and second wheels of said trailer absorbing said torque of said motor enabling stable operation of said valve operating apparatus.

6. A valve operating apparatus for operating a valve comprising a trailer, said trailer includes a frame, a valve motor, a valve key, said valve key secured to said valve motor for operation therewith, a pump to power said valve motor, a first shroud, a second shroud, said valve motor affixed to said second shroud, said second shroud pivotally mounted to said first shroud, said first shroud pivotally mounted to said trailer, and, said first and second shrouds enabling alignment of said valve motor and said valve key with said valve when said frame of said trailer is positioned other than directly over said valve.

7. A valve operating apparatus as claimed in claim 6 wherein said frame includes a telescoping extension bar, said telescoping extension bar extendable to one of said plurality of positions, and said valve operating apparatus being substantially balanced when said telescoping extension bar is extended to one of said plurality of positions enabling operation of said valve operating apparatus without substantial application of force to said telescoping extension bar.

* * * * *

UNITED STATES PATENT AND TRADEMARK OFFICE

CERTIFICATE OF CORRECTION

PATENT NO. : 5,810,051

DATED : September 22, 1998

INVENTOR(S) : John A. Campagna and Jon Stevenson

It is certified that error appears in the above-identified patent and that said Letters Patent is hereby corrected as shown below:

Col. 5, line 50, delete "battery 7", and insert -- battery 26 --.

Signed and Sealed this

Twenty-sixth Day of January, 1999

*Attest:*

*Attesting Officer*

*Acting Commissioner of Patents and Trademarks*